US006014981A

United States Patent [19]

Douglass

[11] Patent Number: 6,014,981

[45] Date of Patent: Jan. 18, 2000

[54] WALKER FORMED SUBSTANTIALLY FROM A POLYMER

[76] Inventor: Karl J. Douglass, 3730 Dogwood La., Doylestown, Pa. 18901

[21] Appl. No.: 08/944,317

[22] Filed: Oct. 6, 1997

[51] Int. Cl.[7] ..... A61H 3/00

[52] U.S. Cl. ..... 135/67; 135/74

[58] Field of Search ..... 135/67, 72, 74, 135/75; 482/66, 68

[56] References Cited

U.S. PATENT DOCUMENTS

| | | |
|---|---|---|
| 2,634,790 | 4/1953 | Elle . |
| 2,708,473 | 5/1955 | Gable et al. . |
| 3,289,685 | 12/1966 | Parker . |
| 4,094,331 | 6/1978 | Rozsa . |
| 4,135,535 | 1/1979 | Thomas . |
| 4,491,257 | 1/1985 | Ingles . |
| 4,941,496 | 7/1990 | Berning . |
| 5,005,599 | 4/1991 | Cunningham . |
| 5,201,333 | 4/1993 | Shalmon et al. . |
| 5,255,696 | 10/1993 | Leonard . |
| 5,311,880 | 5/1994 | Lancaster et al. . |
| 5,339,853 | 8/1994 | Sokolis et al. . |
| 5,445,174 | 8/1995 | Cunningham . |
| 5,469,343 | 11/1995 | Speck . |
| 5,495,867 | 3/1996 | Block . |
| 5,520,597 | 5/1996 | Tobin . |
| 5,529,425 | 6/1996 | Spies et al. . |
| 5,579,793 | 12/1996 | Gajewski et al. . |
| 5,657,783 | 8/1997 | Sisko et al. . |
| 5,862,825 | 1/1999 | Leonard ..... 135/67 |

*Primary Examiner*—Christopher T. Kent

*Attorney, Agent, or Firm*—Akin, Gump, Strauss, Hauer & Feld, L.L.P.

[57] ABSTRACT

The present invention is directed to a walker. The walker includes a front frame having opposing lateral ends and which is formed substantially from a polymer. First and second side frames are connected to the front frame at the lateral ends thereof, respectively. Each side frame is formed substantially from a polymer and has fore and aft generally vertical leg portions. A first handle is positioned at an upper region of each side frame. The side frames can be pivotally mounted to the front frame.

26 Claims, 4 Drawing Sheets

WALKER FORMED SUBSTANTIALLY FROM A POLYMER

FIELD OF THE INVENTION

The present invention relates to an improved design for an orthopedic walker and, more particularly, to an improved design that permits the walker to be formed substantially from a polymer.

BACKGROUND OF THE INVENTION

A professional orthopedic walker (not shown) is typically constructed from one inch tubing formed from aluminum or another metal material, and includes a front portion and side portions extending from the lateral ends of the front portion such that a walker user stands between the side portions and rests on handles built into the side portions. Each side portion typically has two legs, where the legs have wheels or non-skid end caps.

While many improvements to such conventional walkers have been proposed (e.g., a foldable walker, upper and lower sets of handles, attached lights, attached basket, etc.), the basic design has currently remained the same. However, it has been observed that such basic design looks utilitarian and even "medical", and that such appearance reduces an individual's desire to use a conventional walker. Moreover, it has been observed that such an appearance can act as a social barrier by causing other people to feel awkward about approaching the walker user. While it is known that objects such as walkers can be made more "friendly" simply by the addition of one or more "friendly" colors, such addition of colors is limited in aluminum walkers.

As is also known, a conventional aluminum walker can be relatively expensive in terms of material and manufacturing costs. Further, such conventional aluminum walkers can be relatively heavy. Generally, there is a reduction of material costs, manufacturing costs and weight, when an object is constructed from a polymer rather than from a metal, such as the aluminum. Moreover, in constructing polymer objects, the addition of one or more colors is relatively simple, usually by adding pigment to the raw polymer prior to formation into the object. However, polymers normally have less rigorous mechanical, tensile and other properties than metals, with a result that a polymer version of an object cannot perform the same functions as an otherwise identical metal version of the object. As should be evident, then, prior to the present invention it was not possible to simply replace a conventional aluminum walker with an otherwise identical polymer walker.

Accordingly, a need exists for an improved design for a walker, where the walker design can be constructed from an appropriate relatively less expensive and relatively lighter polymer, and where such walker is less expensive to manufacture. Moreover, a need exists for such a polymer walker that is as reliable and sturdy as a conventional aluminum walker.

BRIEF SUMMARY OF THE INVENTION

Briefly stated the present invention is a walker. The walker includes a front frame having opposing lateral ends and which is formed substantially from a polymer. First and second side frames are connected to the front frame at the lateral ends thereof, respectively. Each side frame is formed substantially from a polymer and has fore and aft generally vertical leg portions. A first handle is positioned at an upper region of each side frame.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
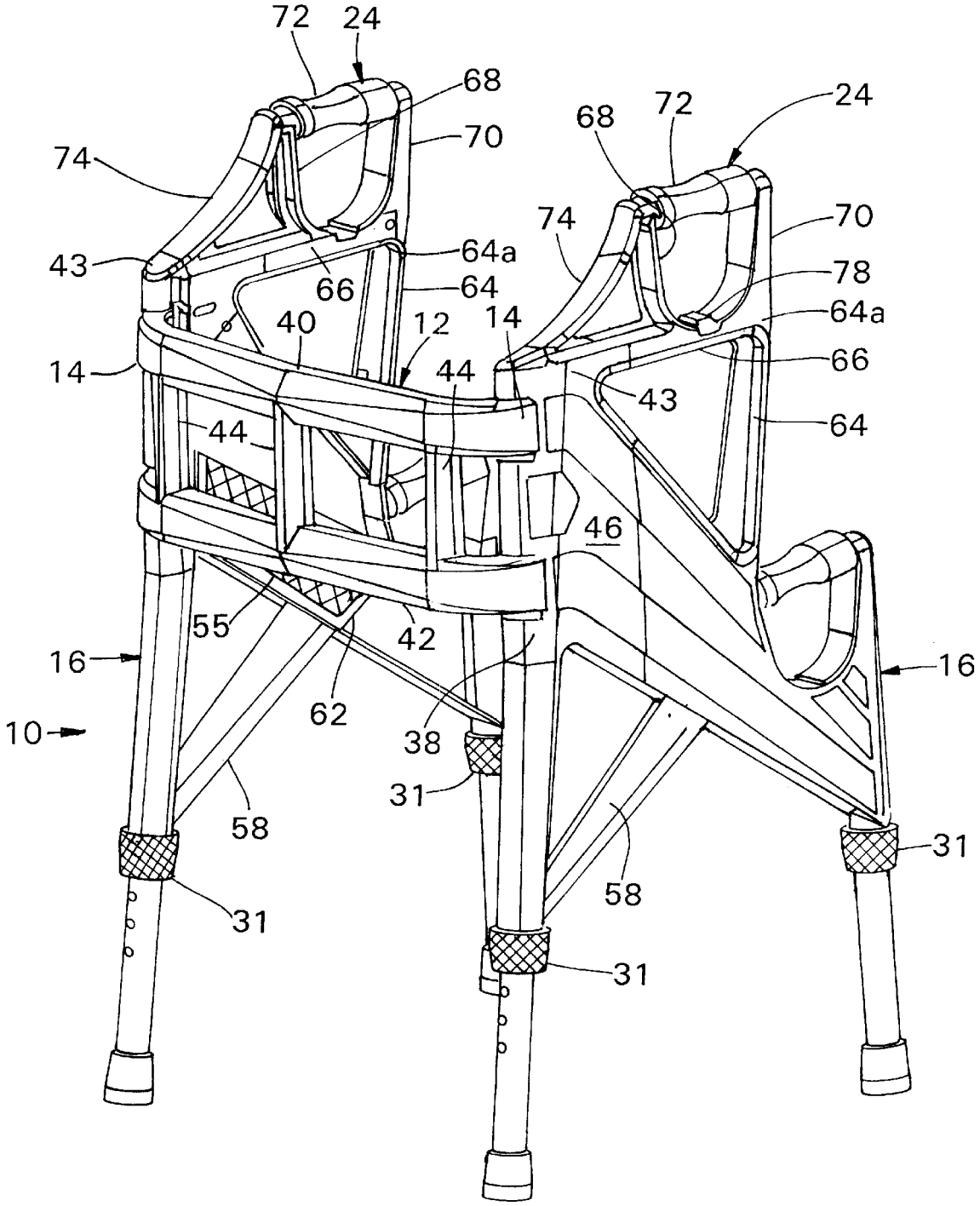
FIG. 1 is front perspective view of a walker in accordance with a preferred embodiment of the present invention.

Certain terminology may be used in the following description for convenience only and is not limiting. The words "left", "right", "upper", and "lower" designate directions in the drawings to which reference is made. The words "inwardly" and "outwardly" refer to directions toward and away from, respectively, the geometric center of the walker and designated parts thereof. The terminology includes the words above specifically mentioned, derivatives thereof, and words of similar import.

Figure 2:
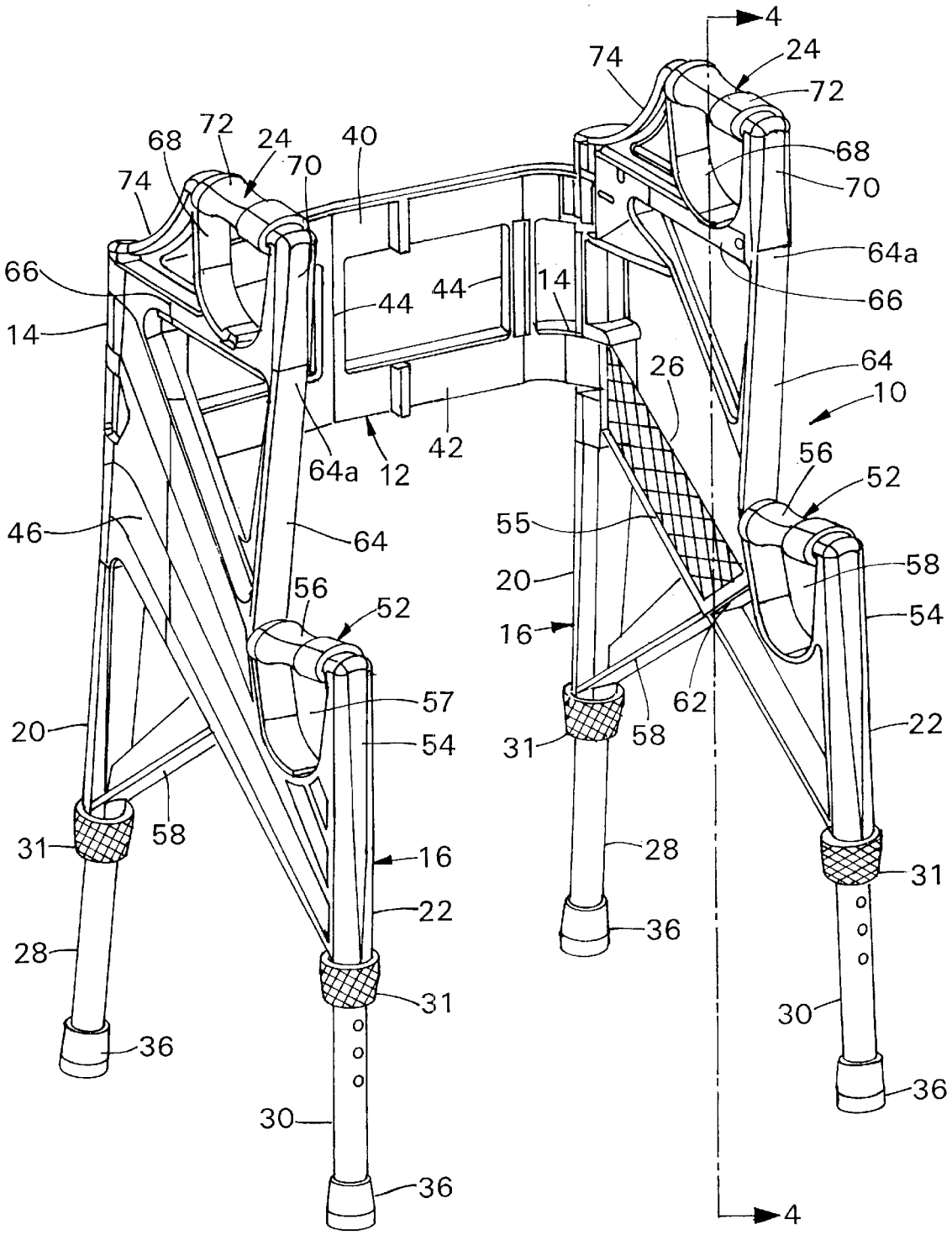
FIG. 2 is a rear perspective view of the walker shown in FIG. 1.
Figure 3:
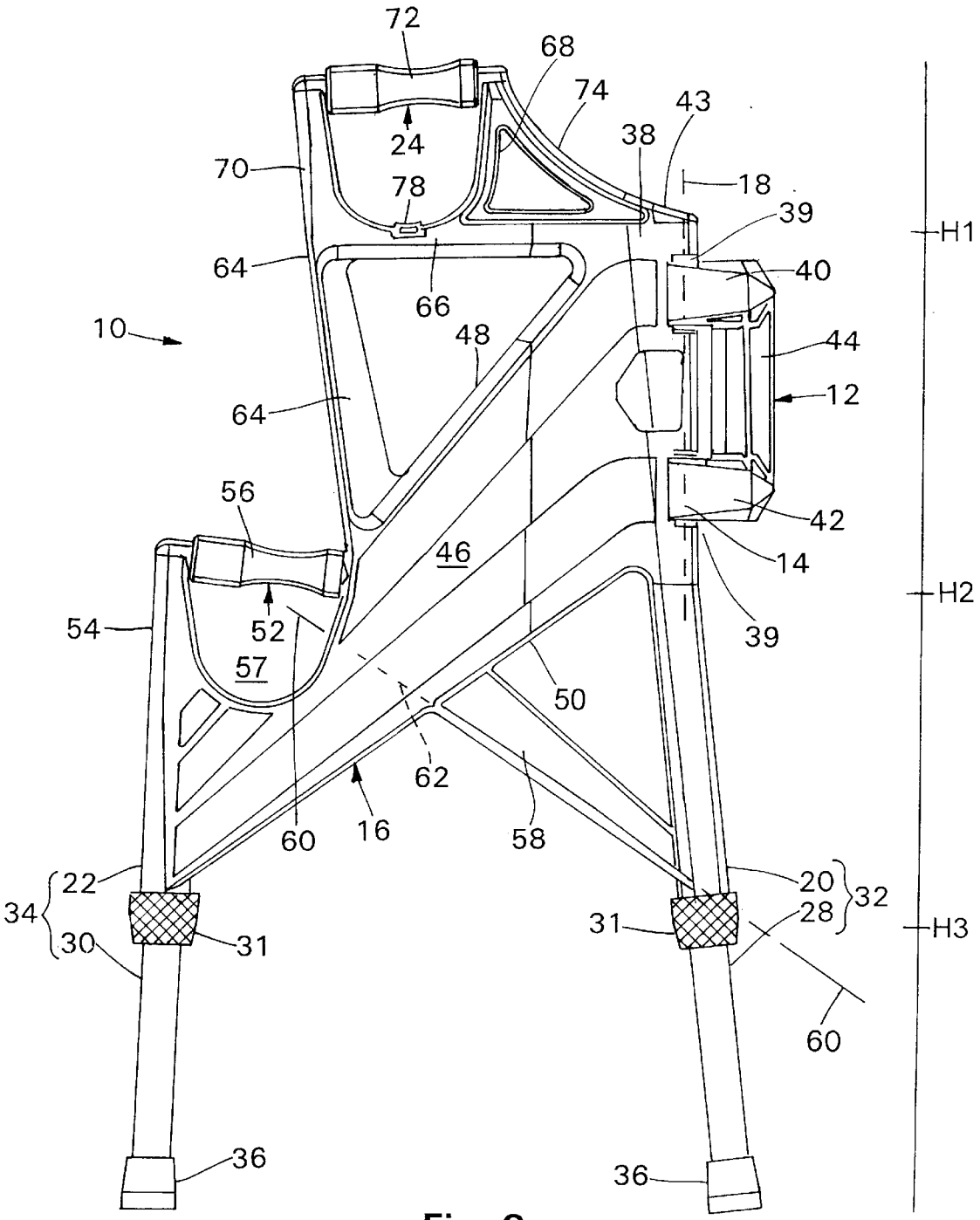
FIG. 3 is a left side elevational view of the walker shown in FIG. 1.

Referring to the drawings in detail, wherein like numerals are used to indicate like elements throughout, there is shown in FIGS. 1–4 a walker, generally designated 10, in accordance with a preferred embodiment of the present invention. As seen, the walker has a front frame 12 with opposing lateral ends 14, and side frames 16 connected to the front frame 12 at the lateral ends 14, respectively. In the preferred embodiment each side frame 16 is pivotable with respect to the front frame 12 about a generally vertical pivot axis 18 (shown in FIG. 3) coextensive with the respective lateral end 14, as described in more detail hereinafter. Each side frame 16 has fore and aft generally vertical leg portions 20, 22, respectively. A first handle 24 is positioned at an upper region of each side frame 16. It should be understood that the side frame shown in FIG. 3 is a mirror image of the side frame 16 on the opposite side of the walker 10.

While in the preferred embodiment it is preferred that the side frames 16 are pivotable with respect to the front frame 12, it is understood by those of ordinary skill in the art from this disclosure that the present invention is not limited to pivotally mounting the side frames 16 to the front frame 12. That is, the side fames 16 could be fixed in position with respect to the front frame 12, without departing from the spirit and scope of the invention.

In the preferred embodiment, each of the front frame 12 and the side frames 16 is formed substantially from a polymer. Although not required, it is also preferred that about 5–10% of the volume of the polymer be filled with glass fibers, to further add to the structural integrity of the walker 10. The present invention is not limited to using any particular polymer or glass fiber. The polymer must have the necessary characteristics such that when it is formed as shown in FIGS. 1–4, the walker 10 can be used for its intended purpose without failure. Examples of polymers which satisfy this criteria include, the polypropylene manufactured by Sundance Products, Inc. of Gainesville, Ga. as product code number SP200-6B; the polypropylene copolymer sold under the trade name Pro-fax SB-823 by the General Polymers division of Ashland Chemical of Atlanta, Ga.; and polypropylene AP 7310 sold by Polycom Huntsman of Washington, Pa.

Preferably, each of the front frame 12 and the side frames 16 is formed from the polymer substantially as a unitary body. Accordingly, each of the front frame 12 and the side frames 16 may be formed substantially as one piece in a single process from a single mold through structural foam injection molding or the like. Of course, one skilled in the art will appreciate from this disclosure that other means of forming the aforementioned frame elements may be employed, such as straight injection molding, blow molding, or thermoforming, without departing from the scope of the present invention. Moreover, one skilled in the art will appreciate that each of the aforementioned frame elements need not be entirely formed as a unitary body. For example, and as seen in FIG. 2, one of the side frames 16 may include netting or mesh 26 or the like to form a small pocket in the side frame 16.

As best seen in FIG. 2, the fore and aft leg portions 20, 22 of each side frame 16 are fore and aft upper leg portions 20, 22 and the walker 10 also has fore and aft generally vertical lower leg portions 28, 30. As such, the fore and aft upper and lower leg portions 20, 22, 28, 30, respectively combine to form fore and aft legs 32, 34, as seen in FIG. 3.

As shown, the fore and aft legs 32, 34 are adjustable by adjusting the fore and aft lower leg portions 28, 30, with respect to the fore and aft upper leg portions 20, 22. Preferably, the fore and aft upper leg portions 20, 22 of each side frame 16 are generally tubular, and the fore and aft lower leg portions 28, 30 telescope down from within the respective upper tubular leg portions 20, 22. Also preferably, appropriate locking threaded collar/pin type devices 31 are provided to secure each leg 32, 34 at the suggested height. The present invention is not limited to any particular locking device and further description of the locking devices is omitted for purposes of brevity and convenience only as such locking devices are well understood by those of ordinary skill in the art.

While it is preferred that the fore and aft legs 32, 34 be height adjustable, one skilled in the art will appreciate from this disclosure that the height of each leg 32, 34 may be fixed without departing from the spirt and scope of the present invention. In fact, it may be desired to produce several different models of the walker 10 with fixed leg heights, rather than to provide the aforementioned adjustable legs. Similarly, the present invention is not limited to constructing the fore and aft legs 32, 34 substantially of a polymer. For instance, the fore and aft lower leg portions 28, 30 could be constructed of aluminum tubing, without departing from the spirit and scope of the invention.

As seen, each leg 32, 34 includes an anti-skid end cap 36. However, one skilled in the art will appreciate that wheels or other devices (not shown) may replace some or all of the end caps 36 without departing from the spirit and scope of the present invention.

Since, in a conventional aluminum walker, the aluminum is a relatively strong material, little need or consideration need be given to stress factors, tensile strength, load bearing weights, and other structural engineering concerns. Simply put, it can usually be assumed that the typical one inch aluminum tubing will provide proper structural support for most typical walker users. Polymers, on the other hand, are not typically relatively strong materials as compared with aluminum, and therefore the aforementioned structural engineering factors become much more of a concern. However, because polymers can be formed into a multitude of shapes, the walker 10 of the present invention has been provided with a geometrical shape which can efficiently withstand the imposed loads, even after being exposed to environmental conditions (e.g., temperature, ultraviolet degradation, sand/dirt, bacteria, etc.) that can degrade the polymer.

In the walker 10 of the present invention, it has been found that the heaviest stresses occur at the pivot axes 18 or where the side frames 16 meet the front frame 12 at the respective lateral ends 14 thereof. Accordingly, it is preferable that each side frame 16 has a relatively sturdy pivot portion 38 (as seen in FIGS. 1 and 3) at a fore side corresponding to the fore leg 32, where the pivot or front portion 38 is generally coextensive with the pivot axis 18 and extends from a first vertical height H1 above a main portion of the front frame 12 to a second vertical height H2 below the main portion of the front frame 12, as is shown in FIG. 3. As seen, each upper leg portion 20, 22 extends down from about the second vertical height H2 to a third vertical height H3.

Figure 4:
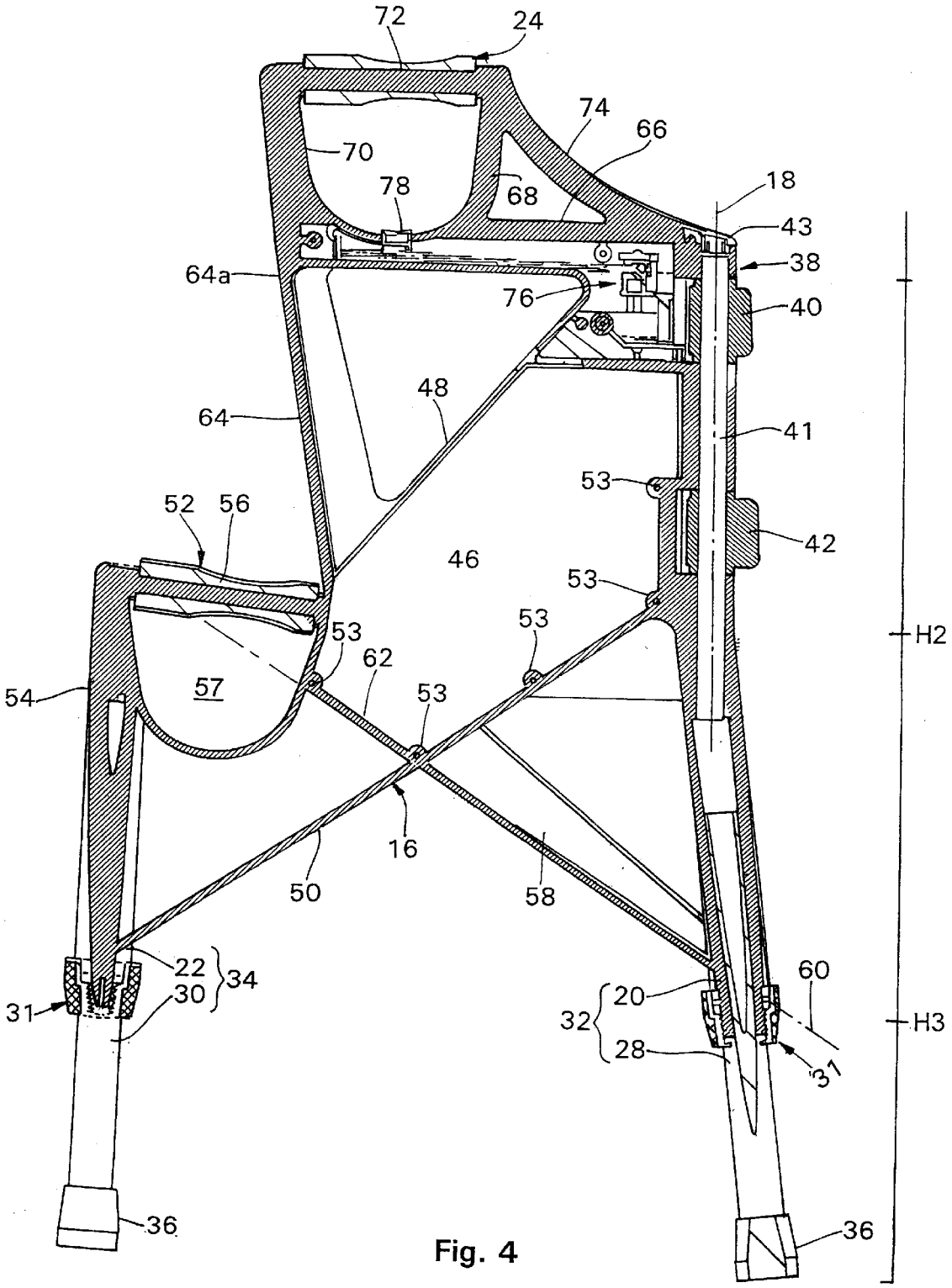
FIG. 4 is an enlarged cross-sectional view of the walker shown in FIG. 2 taken along lines 4—4 of FIG. 2.

Referring now to FIGS. 1, 3 and 4, it is seen that the front frame 12 preferably has upper and lower generally horizontal cross bars 40, 42 spaced a predetermined generally vertical distance apart from one another, where each cross bar 40, 42 extends between the opposing lateral ends 14 of the front frame 12. The cross bars 40, 42 are generally linear in the middle with generally arcuate terminal ends. The terminal ends of the cross bars 40, 42 include generally vertically extending bores which rotatably receive a complementary hollow pintle 41. The pintle 41 also extends through a complementary bore in the pivot portion 38 both between the cross bars 40, 42 and just below the lower cross bar 42. A gap 39 is provided in the pivot portion 38 for receiving the terminal ends of the cross bars 40, 42. The pintle 41 permits the side frames 16 to pivot with respect to the front frame 12.

The present invention is not limited to constructing the pintle 41 of any particular material. The pintle 41 could constructed of the same polymer as that used to construct the balance of the walker 10 or could be constructed of a light weight high strength material, such as aluminum. It is also understood by those of ordinary skill in the art from this disclosure that the pintle 41 could be solid (not shown) as opposed to hollow. The benefit of a hollow pintle 41 is that a removable cap 43 can be releasably positioned at the top of the pivot portion 38 in alignment with the pintle 41. When the cap 43 is removed, various items can be releasably mounted in the pintle 41, such as an umbrella and an I.V. tube support rod (not shown).

In the preferred embodiment, the front frame 12 has at least one generally vertical pillar 44 interconnecting the upper and lower cross bars 40, 42. As seen in FIG. 1, three pillars 44, are preferably provided, although one skilled in the art will appreciate that other numbers of pillars may be provided without departing from the spirit and scope of the present invention. Preferably, the first vertical height H1 is just above the upper cross bar 40 and the second vertical height H2 is just below the lower cross bar 42.

In using the walker 10, the greatest load occurs when the walker user moves the walker 10 forward and rests the walker 10 on the aft legs 34 while at the same time bearing down on the first handles 24. Accordingly, such load is preferably transferred from the pivot portion 38 down to the aft legs 34 by way of a main support 46 that extends generally diagonally from the pivot portion 38 at the fore side to the upper aft leg portion 22 at the aft side of the side frame 16. As best seen in FIGS. 3 and 4, the main support 46 at the fore side (corresponding to the fore leg 32) extends from about the first vertical height H1 to the second vertical height H2. Accordingly, the main support 46 preferably joins directly to the pivot portion 38 along substantially the entirety of the vertical height of the pivot portion 38. As also seen, the main support 46 at the aft side of the side frame 16 (corresponding to the aft leg 34) extends up from about the third vertical height H3. Generally, the main support 46 has an upper side 48 and a lower side 50 (as shown in FIGS. 3 and 4) which converge toward each other in the direction of the aft legs 34, although it is seen that an aft portion of the upper side 48 is interrupted by a second handle 52 positioned thereatop. The main support 46 is generally U-shaped in cross section with the open end of the "U" facing inwardly toward the other side frame 16. The legs of the U-shaped main support 26 include fastener bosses 53 for receiving standard fasteners 55 (i.e., self tapping screws) to attach the netting 26 to the side frame 16, as shown in FIGS. 1, 2 and 4.

More specifically, it is seen that the second handle 42 includes an upper segment 54 of the upper aft leg portion 22 as an aft post and a generally horizontal grip 56 at about the second vertical height H2 extending between the aft post 54 and the upper side 48 of the main support 46. Accordingly, the second handle 52 defines a gripping aperture 57 which extends into the main support 46.

As should now be understood, when a walker user grasps the grip 56 of the second handle 52 to, for example, rise out of a chair, the load exerted by the walker user onto the grip 56 is transferred through the upper segment 54 of the upper aft leg portion 22 and through the main support 46 to the fore leg 32. Of course, one skilled in the art will appreciate that equivalent structural schemes may be employed for the second handle 52 without departing from the spirit and scope of the present invention.

Referring now to FIGS. 3 and 4, the side frame 16 has a first strut 58 extending generally diagonally from a midpoint on the lower side 50 of the main support 46 to the upper fore leg portion 20 at about the third vertical height H3. The first strut 58 is generally T-shaped in cross section, the bottom portion of which faces the floor (not shown) and extends generally along a first line 60. The main support 46 further has a first rib 62 extending from the lower side 50 to the upper side 48 generally along the first line 60. The first rib 62 and the first strut 58 provide the walker 10 with structural integrity. While it is preferred that the first strut 58 be generally T-shaped in cross section, it is understood by those of ordinary skill in the art that the first strut 58 could have other configurations, such as generally I-shaped in cross section.

Referring now to FIGS. 1, 3 and 4, each side frame 16 further includes a second strut 64 extending generally vertically from a midpoint on the upper side 48 of the main support 46 to an end 64*a* thereof at about the first vertical height H1. The second strut 64 is preferably generally T-shaped in cross section. A third strut 66 extends generally horizontally from the upper side 48 of the main support 46 at about the first vertical height H1 to the end 64*a* of the second strut 64 at about the first vertical height H1. The first handle 24 is positioned atop an aft portion of the third strut 66, the first handle 24 includes fore and aft generally vertical posts 68, 70 and a generally horizontal grip 72 positioned atop the fore and aft posts 68, 70. Each side frame 16 further has a fourth strut 74 extending generally arcuately and diagonally from the upper side 48 of the main support 46 at about the first vertical height H1 to the fore post 68 of the first handle 24 adjacent the grip 72 of the first handle 24.

Referring now to FIG. 4, the third strut 66 and the upper corner of the main support 46 include a hollow area which houses a locking mechanism, generally designated 76, for locking the side frames 16 in the open position. A latch release button 78 is provided in the base of the first handles 24 for releasing the locking mechanism 76 to allow the side frames 16 to be pivoted to the closed position (not shown). The locking mechanism 76 does not pertain to the present invention. Further, such locking mechanisms are well known to those of ordinary skill in the art. Accordingly, a detailed description of the locking mechanism 76 is omitted for purposes of brevity and convenience only and is not limiting.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A walker comprising:

a front frame having opposing lateral ends and being formed substantially from a polymer; and first and second side frames connected to the front frame at the lateral ends thereof, respectively, each side frame being pivotable with respect to the front frame about a generally vertical pivot axis generally coextensive with the respective lateral end, each side frame being formed substantially from a polymer and having fore and aft generally vertical leg portions and a first handle positioned at an upper region of each side frame.

2. The walker of claim 1 wherein the fore and aft leg portions of each side frame are fore and aft upper leg portions, the walker further comprising fore and aft generally vertical lower leg portions, the fore and aft upper and lower leg portions respectively combining to form fore and aft legs.

3. The walker of claim 2 wherein each side frame has fore and aft sides corresponding to the fore and aft legs, respectively, each side frame further having:

a pivot portion at the fore side, the pivot portion being generally coextensive with the pivot axis and extending from a first vertical height above a main portion of the front frame to a second vertical height below the main portion of the front frame, each upper leg portion extending down from about the second vertical height to a third vertical height; and a main support extending generally diagonally from the pivot portion at the fore side to the upper aft leg portion at the aft side, the main support extending from about the first vertical height to the second vertical height at the fore side and extending up from about the third vertical height at the aft side, the main support having an upper side and a lower side.

4. The walker of claim 3:

wherein the front frame has:

upper and lower generally horizontal crossbars spaced a predetermined generally vertical distance apart from one another and extending between the opposing lateral ends of the front frame; and at least one generally vertical pillar interconnecting the upper and lower crossbars; and wherein the first vertical height is above the upper crossbar and the second vertical height is below the lower crossbar.

5. The walker of claim 3 wherein each side frame further has a first strut extending generally diagonally from a midpoint on the lower side of the main support to the upper fore leg portion at about the third vertical height.

6. The walker of claim 5 wherein the first strut extends generally along a first line, and wherein the main support further has a first rib extending from the lower side to the upper side generally along the first line.

7. The walker of claim 3 wherein each side frame further has:

a second strut extending generally vertically from a midpoint on the upper side of the main support to an end thereof at about the first vertical height; and a third strut extending generally horizontally from the upper side of the main support at about the first vertical height to the end of the second strut at about the first vertical height;

wherein the first handle is positioned atop an aft portion of the third strut, the first handle including fore and aft generally vertical posts and a generally horizontal grip positioned atop the fore and aft posts.

8. The walker of claim 7 wherein each side frame further has a fourth strut extending generally diagonally from the upper side of the main support at about the first vertical height to the fore post of the first handle adjacent the grip of the first handle.

9. The walker of claim 3 wherein each side frame further has a second handle positioned atop an aft portion of the upper side of the main support, the second handle including an upper segment of the upper aft leg portion as an aft post and a generally horizontal grip at about the second vertical height extending between the aft post and the upper side of the main support.

10. The walker of claim 9 wherein the second handle defines a gripping aperture which extends into the main support.

11. The walker of claim 2 wherein the fore and aft upper leg portions of each side frame are tubular, and wherein the fore and aft lower leg portions telescope down from within the respective upper tubular leg portions.

12. The walker of claim 1 wherein the front frame is formed substantially as a unitary body.

13. The walker of claim 1 wherein each side frame is formed substantially as a unitary body.

14. The walker of claim 1 wherein the substantially polymer formed first and second side frames comprise primary load carrying members for imposed loads on the walker.

15. A walker comprising:

a front frame having opposing lateral ends and being formed substantially from a polymer; and first and second side frames connected to the front frame at the lateral ends thereof, respectively, each side frame being formed substantially from a polymer and having fore and aft generally vertical leg portions and a first handle positioned at an upper region of each side frame.

16. The walker of claim 15 wherein the fore and aft leg portions of each side frame are fore and aft upper leg portions, the walker further comprising fore and aft generally vertical lower leg portions, the fore and aft upper and lower leg portions respectively combining to form fore and aft legs.

17. The walker of claim 16 wherein each side frame has fore and aft sides corresponding to the fore and aft legs, respectively, each side frame further having:

a front portion at the fore side extending from a first vertical height above a main portion of the front frame to a second vertical height below the main portion of the front frame, each upper leg portion extending down from about the second vertical height to a third vertical height; and a main support extending generally diagonally from the front portion at the fore side to the upper aft leg portion at the aft side, the main support extending from about the first vertical height to the second vertical height at the fore side and extending up from about the third vertical height at the aft side, the main support having an upper side and a lower side.

18. The walker of claim 17:

wherein the front frame has:

upper and lower generally horizontal crossbars spaced a predetermined generally vertical distance apart from one another and extending between the opposing lateral ends of the front frame; and at least one generally vertical pillar interconnecting the upper and lower crossbars; and wherein the first vertical height is above the upper crossbar and the second vertical height is below the lower crossbar.

19. The walker of claim 17 wherein each side frame further has a first strut extending generally diagonally from a midpoint on the lower side of the main support to the upper fore leg portion at about the third vertical height.

20. The walker of claim 19 wherein the first strut extends generally along a first line, and wherein the main support further has a first rib extending from the lower side to the upper side generally along the first line.

21. The walker of claim 17 wherein each side frame further has:

a second strut extending generally vertically from a midpoint on the upper side of the main support to an end thereof at about the first vertical height; and a third strut extending generally horizontally from the upper side of the main support at about the first vertical height to the end of the second strut at about the first vertical height;

wherein the first handle is positioned atop an aft portion of the third strut, the first handle including fore and aft generally vertical posts and a generally horizontal grip positioned atop the fore and aft posts.

22. The walker of claim 19 wherein each side frame further has a fourth strut extending generally diagonally from the upper side of the main support at about the first vertical height to the fore post of the first handle adjacent the grip of the first handle.

23. The walker of claim 17 wherein each side frame further has a second handle positioned atop an aft portion of the upper side of the main support, the second handle including an upper segment of the upper aft leg portion as an aft post and a generally horizontal grip at about the second vertical height extending between the aft post and the upper side of the main support.

24. The walker of claim 23 wherein the second handle defines a gripping aperture which extends into the main support.

25. The walker of claim 16 wherein the fore and aft upper leg portions of each side frame are tubular, and wherein the fore and aft lower leg portions telescope down from within the respective upper tubular leg portions.

26. The walker of claim 15 wherein the front frame is formed substantially as a unitary body.

* * * * *